US006997132B2

(12) United States Patent
Steen

(10) Patent No.: US 6,997,132 B2
(45) Date of Patent: Feb. 14, 2006

(54) SEMI-SUBMERSIBLE OFFSHORE VESSEL AND METHODS FOR POSITIONING OPERATION MODULES ON SAID VESSEL

(75) Inventor: Gerry Steen, Göteborg (SE)

(73) Assignee: GVA Consultants AB, Gothenburg (SE)

( * ) Notice: Subject to any disclaimer, the term of this patent is extended or adjusted under 35 U.S.C. 154(b) by 0 days.

(21) Appl. No.: 10/834,921

(22) Filed: Apr. 30, 2004

(65) Prior Publication Data

US 2005/0217554 A1 Oct. 6, 2005

(30) Foreign Application Priority Data

Apr. 2, 2004 (SE) ..... 0400909

(51) Int. Cl.
*B63B 35/44* (2006.01)

(52) U.S. Cl. ..... 114/265; 114/259

(58) Field of Classification Search ..... 114/264, 114/265, 61.12, 61.14, 259, 260; 405/204
See application file for complete search history.

(56) References Cited

U.S. PATENT DOCUMENTS

| | | | | |
|---|---|---|---|---|
| 3,078,680 A * | 2/1963 | Wepsala | 405/209 |
| 4,744,697 A * | 5/1988 | Coppens | 405/204 |
| 6,048,135 A * | 4/2000 | Williford et al. | 405/196 |
| 6,340,272 B1 * | 1/2002 | Runge et al. | 405/203 |
| 6,854,411 B1 * | 2/2005 | Ankarsward | 114/265 |
| 2005/0058513 A1 * | 3/2005 | Martensson et al. | 405/203 |

FOREIGN PATENT DOCUMENTS

| | | | |
|---|---|---|---|
| GB | 2 086 314 | * | 5/1982 |
| WO | WO 96/23690 A1 | | 8/1996 |
| WO | WO 01/60688 A1 | | 8/2001 |

* cited by examiner

*Primary Examiner*—Sherman Basinger
(74) *Attorney, Agent, or Firm*—Birch, Stewart, Kolasch & Birch, LLP

(57) ABSTRACT

A semi-submersible offshore vessel has a substantially ring-shaped lower pontoon, starboard and port forward columns extending upwards from the lower pontoon, and starboard and port aft columns extending upwards from the lower pontoon. An upper deck structure connects upper portions of the columns with each other. The upper deck structure has a substantially rectangular module recess for receiving one or more operation modules, for example, carrying hydrocarbon-processing equipment. The upper deck structure is generally C-shaped, having a forward torsion box extending transversally between the starboard and the port forward columns of the semi-submersible offshore vessel, and two mutually parallel longitudinal side beams extending aft from the starboard and port forward columns to the starboard and port aft columns, respectively, in such a way that the module recess exhibits an open aft end, the width of which substantially corresponds to the width of an operation module. The module recess is delimited in a downward direction by a substantially planar module deck, which extends between and interconnects the longitudinal side beams.

17 Claims, 5 Drawing Sheets

SEMI-SUBMERSIBLE OFFSHORE VESSEL AND METHODS FOR POSITIONING OPERATION MODULES ON SAID VESSEL

This Non-provisional application claims priority under 35 U.S.C. § 119(a) on Patent Application No(s). 0400909-8 filed in Sweden on Apr. 2, 2004, the entire contents of which are hereby incorporated by reference.

TECHNICAL FIELD

The present invention relates to a semi-submersible offshore vessel comprising a substantially ring-shaped lower pontoon, at least four columns extending upwards from said lower pontoon, and an upper beam structure connecting upper portions of the columns with each other. The offshore vessel is especially designed to be fitted with one or more operation modules, for example carrying hydrocarbon processing equipment. The invention also discloses methods for positioning operation modules on said vessel.

BACKGROUND

In conventional semi-submersible vessels, a load-supporting, rectangular deck-box structure is positioned upon the top of the columns. Operation modules are then placed on top of the deck-box structure. The deck-box structure offers a structurally solid design and may be of a sealed type, which adds reserve buoyancy to the vessel in an eventual damaged emergency state.

The semi-submersible vessel is used for various services such as production of hydrocarbons, drilling and/or to provide accommodation for personnel. To provide these services, the vessel is equipped with various equipment and systems, which may either be located directly in the deck structure or upon the deck-box structure.

However, a disadvantage with this conventional design is that the operational modules have to be placed relatively high on the vessel which leads to a high center of gravity for the operational modules, and accordingly for the completed vessel. This results in a reduction in stability for the vessel and as a consequence—a lesser pay-load, or alternatively the size of the vessel has to be increased to compensate for the high vertical center of gravity of the operational modules. Furthermore, the weight and the size of these operational modules are normally such that there is only a limited number of devices available that can lift them, a fact that limits the number of available construction sites worldwide.

OBJECTS OF THE INVENTION

It is an object of the present invention to provide an effective and globally strong semi-submersible offshore vessel, which allows separate operational modules to be fitted to the vessel in an efficient and cost-effective manner whilst still maintaining a low point of gravity and sufficient structural strength when compared to known designs. Another object is to provide an offshore vessel, which provides a well defined and easily accessible space for fitting the operational module or modules, in such a way that said module or modules may be fabricated/contracted separately from the vessel and conveniently fitted to the vessel, possibly at a different building facility.

SUMMARY OF THE INVENTION

The above mentioned objects are achieved by the invention providing a semi-submersible offshore vessel comprising:

- a substantially ring-shaped lower pontoon;
- starboard and port forward columns extending upwards from said lower pontoon;
- starboard and port aft columns extending upwards from said lower pontoon, and
- an upper deck structure connecting upper portions of the columns with each other, said upper deck structure having a substantially rectangular module recess for receiving one or more operation modules, for example carrying hydrocarbon processing equipment.

The invention is especially characterized in:

- that said upper deck structure is generally C-shaped, having a forward torsion box extending transversally between the starboard and the port forward columns of the semi-submersible offshore vessel, and two mutually parallel longitudinal side beams extending aft from the starboard and port forward columns to the starboard and port aft columns, respectively, in such a way that said recess exhibits an open aft end, the width of which substantially corresponds to the width of an operation module, and
- that said recess is delimited in a downwardly direction by a substantially planar module deck which extends between—and interconnects—said longitudinal side beams.

In one embodiment of the invention, the forward torsion box is water-displacing and thus sealed from water-intrusion in such a way that it provides emergency reserve buoyancy to the offshore vessel.

In a suitable embodiment of the invention, said module deck is at least double bottomed and arranged to be water-displacing so as to provide emergency reserve buoyancy to the offshore vessel.

In one embodiment of the invention, the longitudinal side beams are arranged to be water-displacing so as to provide emergency reserve buoyancy to the offshore vessel.

In an advantageous embodiment of the invention, the longitudinal side beams include wall sections perforated with a plurality of side-beam openings.

In one embodiment of the invention, said side-beam openings are shaped as substantially triangular cut-outs being oppositely arranged in pairs so as to form a truss-like pattern in said wall sections.

In another embodiment of the invention, each longitudinal side beam is constituted by a truss-structure.

In one embodiment of the invention, load support points for supporting structural load from the operational module or modules, are provided on the module deck, said load support points being located adjacent to the two longitudinal side beams.

In an alternative embodiment of the invention, the operational module or modules, are provided with at least two suspension consoles arranged to abut corresponding load support surfaces on the two longitudinal side beams.

In an advantageous embodiment of the invention, said forward torsion box contains crew accommodation quarters.

Preferably, the module deck has a height corresponding to between one sixth and one third of the height of the longitudinal side beams.

In a suitable embodiment, a bottom plane of the module deck coincides with a bottom plane of the longitudinal side beams.

In one embodiment of the invention, the operation module extends aft of said module deck.

Normally, the module deck exhibits at least one vertical opening adapted for example for riser pipe handling or ventilation.

The module support deck is suitably arranged to accommodate two or more operation modules, said operation modules being located next to each other and extending transversely across the module deck between the two longitudinal side beams.

The forward torsion box may in one embodiment extend forward of the forward columns of the vessel.

Advantageously, the length of the forward torsion box, in a forward-aft direction corresponds to between one fifth to one half of the longitudinal center-to-center distance between the forward columns and the aft columns in an offshore vessel having four columns.

The invention also includes a method for positioning an operation module on the semi-submersible offshore vessel, whereby the operation module is first lifted to a position above the module recess, and is then lowered into the module recess.

According to an alternative method for positioning an operation module on the semi-submersible offshore vessel, the operation module may instead be inserted from the aft into the module recess via the open aft end of said module recess.

In one variant of the methods described above, the operation module may be transferred from a floating barge or other sea-going vessel to the module recess of the offshore vessel.

The invention offers a number of advantages over conventional designs. The generally C-shaped upper deck structure with its central module recess provides excellent global structural strength in combination with the ring pontoon design and the interconnecting module deck. Another advantage is a comparatively low positioning of the operational modules, which results in a lower vertical center of gravity for the vessel. Hence, the vessel may be made be reduced in size with a retained payload in comparison with a conventional vessel.

Other features and advantages of the invention will be further described in the following detailed description of embodiments.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention will now be described in greater detail by way of example only and with reference to the attached drawings, which are given by way of illustration only, and thus are not limitative of the present invention, and in which.

DESCRIPTION OF EMBODIMENTS

Figure 1:
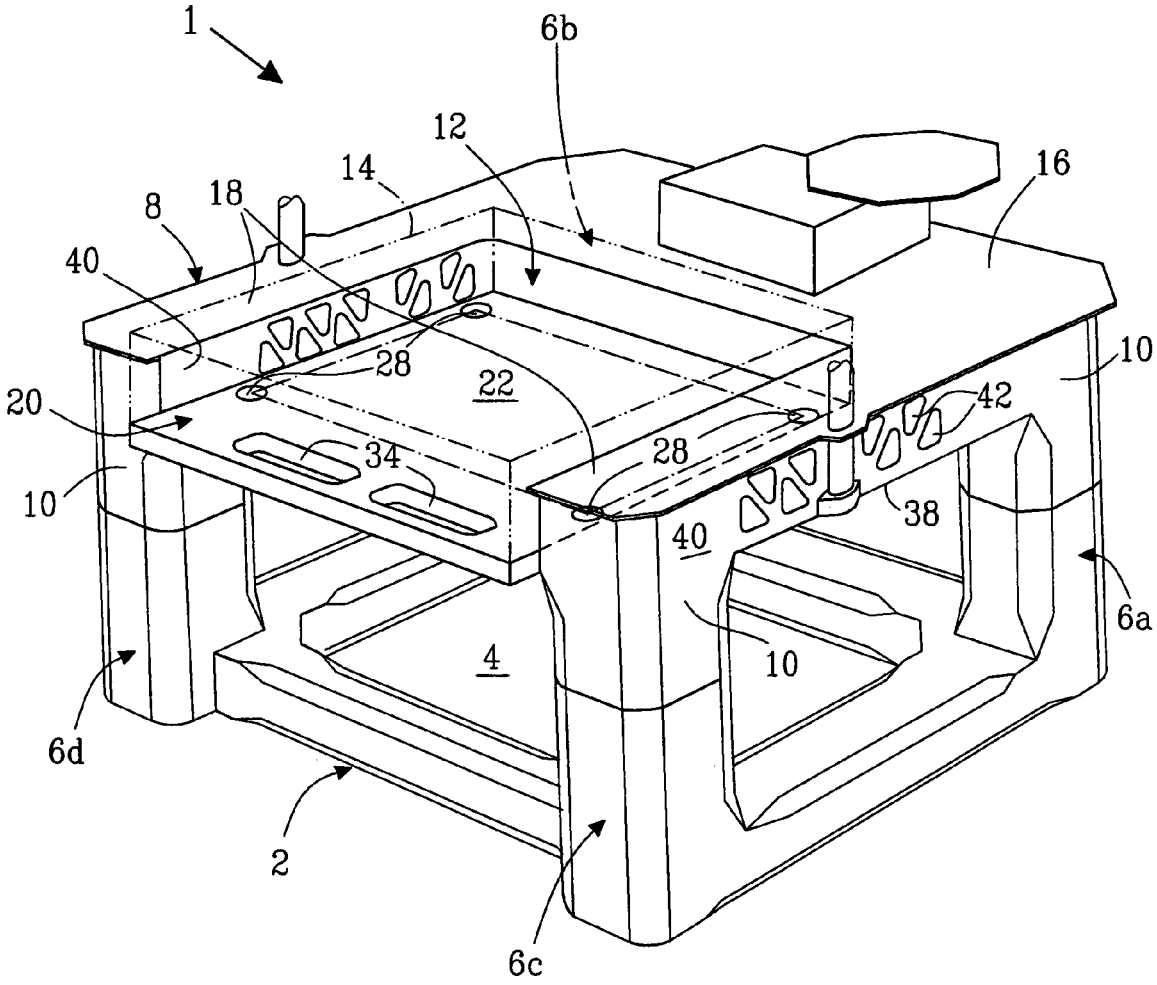
FIG. 1 shows a simplified perspective view of a semi-submersible offshore vessel according to a first embodiment of the invention, having vertical columns extending from a ring-shaped lower pontoon. The operation module is schematically indicated with dotted phantom lines.

In FIG. 1, reference numeral 1 denotes a semi-submersible offshore vessel according to a first embodiment of the invention. The offshore vessel 1 is schematically illustrated without unnecessary detail and comprises a substantially rectangular, ring-shaped lower pontoon 2. The term "substantially ring-shaped" is used here in the meaning of a closed pontoon structure, which encloses a central opening 4. Such a pontoon structure is often popularly referred to simply as a "ring-pontoon". Thus, the pontoon 2 shown in FIG. 1 is generally rectangular, whereas alternative embodiments may include other general pontoon shapes, such as polyhedral or circular pontoons 2 (not shown).

In the embodiment shown in FIG. 1, four columns 6*a*, 6*b*, 6*c*, 6*d* extend vertically upwards from the lower pontoon 2. More particularly, the vessel 1 has a starboard forward column 6*a*, a port forward column 6*b* (hidden in FIG. 1), a starboard aft column 6*c* and finally a port aft column 6*d*. In the shown embodiment, the columns 6*a*, 6*b*, 6*c*, 6*d* have a rounded rectangular cross-section, although the cross-section may alternatively be configured in other ways within the scope of the invention.

As is further shown in FIG. 1, an upper beam structure 8 connects upper portions 10 of the columns 6*a*, 6*b*, 6*c*, 6*d* with each other in order to form a globally strong and resilient vessel design. The upper deck structure 8 has a substantially rectangular module recess 12 for receiving one or more operation modules 14—indicated with dotted phantom lines in FIG. 1. The operation modules 14 may for example commonly be carrying hydrocarbon processing equipment.

According to the invention, the upper deck structure 8 is generally C-shaped, having a forward torsion box 16 extending transversally between the starboard and the port forward columns 6*a*, 6*b* of the semi-submersible offshore vessel 1. The forward torsion box 16 will be described in greater detail later in this description. The "shanks of the C-shape" is formed by two mutually parallel longitudinal side beams 18 extending aft from the starboard and port forward columns 6*a*, 6*b* and the starboard and port aft columns 6*c*, 6*d*, respectively, in such a way that the module recess 12 exhibits an open aft end 20. The width of the open aft end 20 substantially corresponds to the width of an operation module 14.

Furthermore, the module recess 12 is delimited in a downwardly direction by a substantially planar module deck 22, which extends between—and interconnects—the two longitudinal side beams 18. Thus, the C-shaped upper deck structure 8 provides increased global torsion resistance to the vessel 1, in combination with the interconnecting module deck 22. The combination of these features enables the advantageous feature of convenient open aft end 20, whilst still maintaining sufficient global structural strength to withstand the hard weather conditions encountered in offshore operation.

Figure 2:
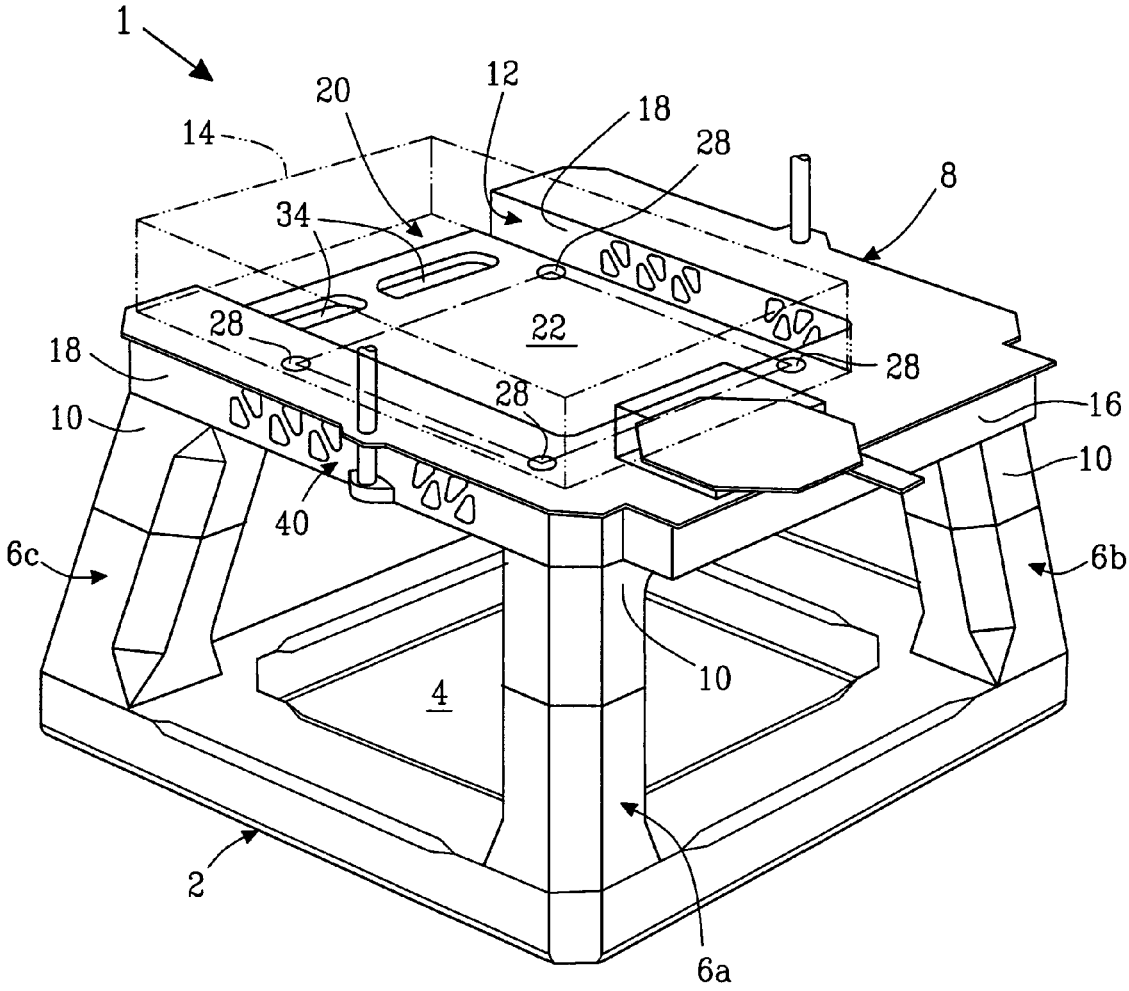
FIG. 2 shows a simplified perspective view of a semi-submersible offshore vessel according to a second embodiment of the invention having inwardly inclined columns extending from a ring-shaped lower pontoon.

FIG. 2 shows a simplified perspective view of a semi-submersible offshore vessel 1 according to a second embodiment of the invention, having inwardly inclined columns 6*a*, 6*b*, 6*c*, 6*d* extending from a ring-shaped lower pontoon 2. Otherwise, this embodiment is similar to the first embodiment described with reference to FIG. 1 above.

Figure 3:
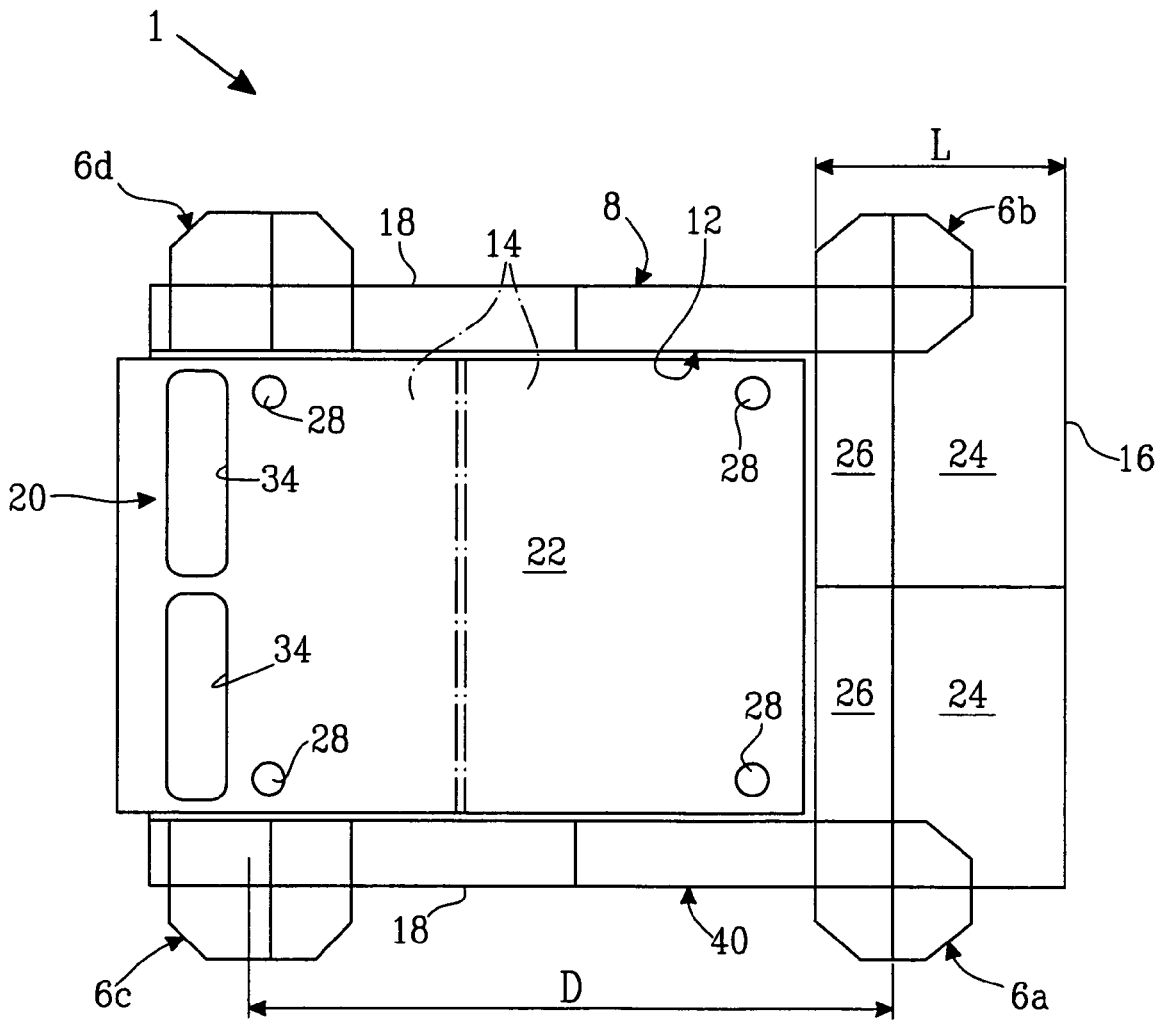
FIG. 3 shows a simplified top elevational view of an alternative embodiment of the semi-submersible offshore vessel.

FIG. 3 is a simplified top elevational view of an alternative embodiment of the semi-submersible offshore vessel 1, having thinner side beams 18 than the embodiments shown in FIGS. 1 and 2. In this top view, the forward torsion box 16 is shown to contains crew accommodation quarters 24 as well as compartments 26 for utilities of various types. Preferably, the forward torsion box 16 is water-displacing and thus sealed from water-intrusion in such a way that it provides emergency reserve buoyancy to the offshore vessel 1. In the embodiment shown in FIG. 3, that the longitudinal side beams 18 are also arranged to be water-displacing so as to provide emergency reserve buoyancy. In this embodiment, as well as in the other shown embodiments, the forward torsion box 16 extends forward of the forward columns 6*a*, 6*b* of the vessel 1. Preferably, the length L (i.e. the longitudinal length) of the forward torsion box 16, in a forward-aft direction corresponds to between one fifth to one half of the longitudinal center-to-center distance D between the forward columns 6*a*, 6*b* and the aft columns 6*c*, 6*d*.

As further seen in FIG. 3, the module deck 22 may also be arranged to accommodate more than one operation module 14. As an example, FIG. 3 thus shows two operation modules 14 located next to each other and extending transversely across the module deck 22 between the two longitudinal side beams 18.

Figure 6:
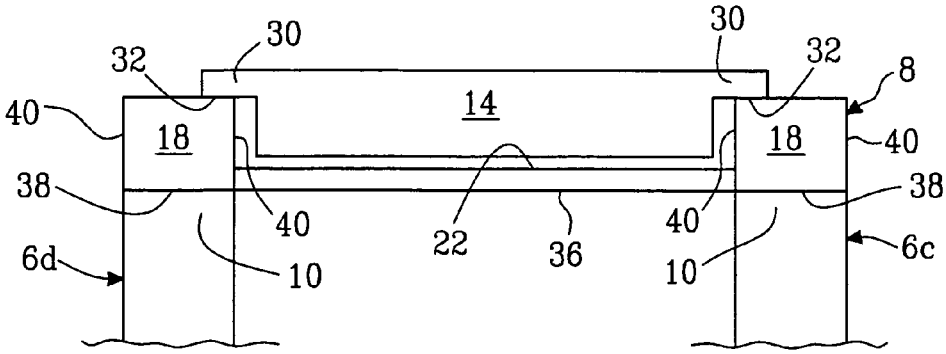

With reference now to FIGS. 1–4, four load support points 28 for supporting structural load from the operational module or modules 14, are provided on the module deck 22. The load support points 28 comprise reinforced structural elements arranged to carry a required predetermined maximum load from the operation module or modules 14. As seen in FIGS. 1–3, the load support points 28 are located adjacent to, or directly next to the two longitudinal side beams 18. The number of support points 28 may vary depending on the shape and number of operation modules 14 used. The circular shape of the load support points 28 are drawn as examples only, and may naturally vary from case to case. In an alternative embodiment, schematically shown in FIG. 6, the operational module or modules 14, are provided with at least two suspension consoles 30 arranged to abut corresponding load support surfaces 32 on the two longitudinal side beams 18.

As shown in FIGS. 1–3, the module deck 22 exhibits at least one vertical opening 34 adapted for example for riser pipe handling or ventilation. These vertical openings may be of various shapes and sizes, although it is preferable that a major part of the module deck is free from such openings 34, in order not to compromise racking and shearing stiffness of the offshore vessel 1.

Figure 4:
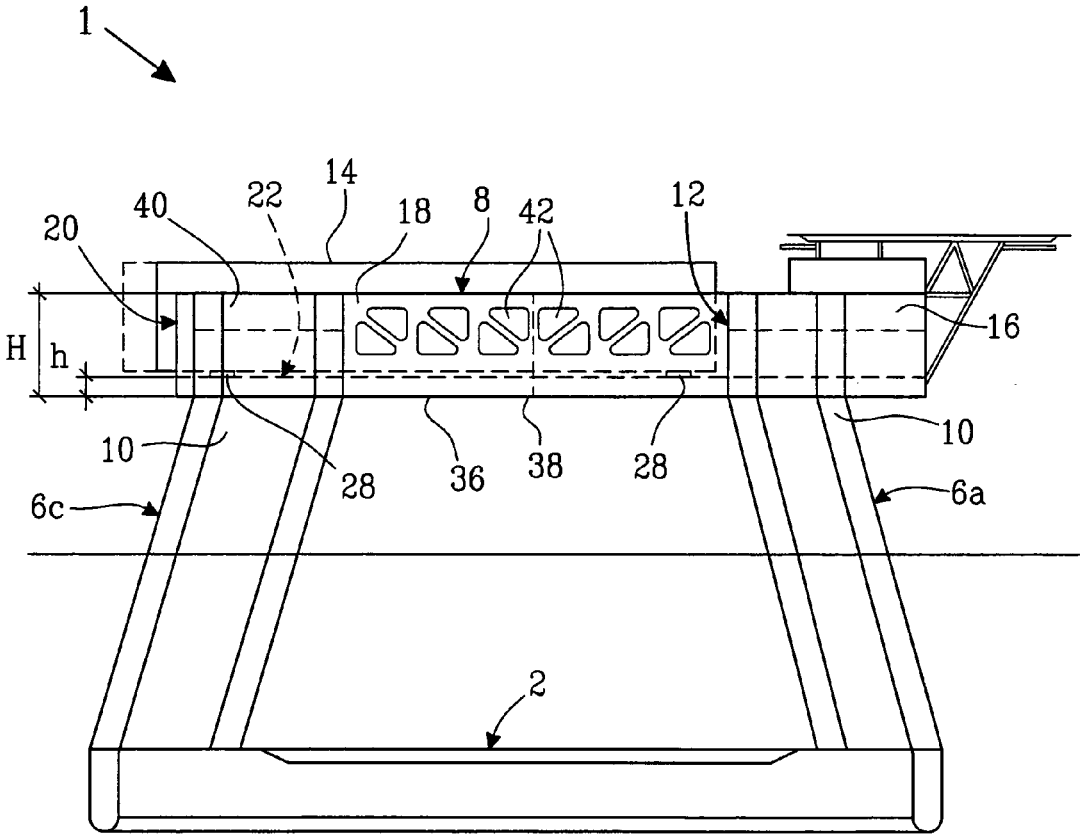
FIG. 4 shows an elevational side view of the alternative embodiment shown in FIG. 3.

As seen in FIGS. 3 and 4, an operation module 14 may extend aft of said module deck 22, due to the open aft end 20 of the module recess 12. This facilitates access to subsea installations other than through the openings 34 in the module deck and enables retrofit add-ons to be attached to an existing operation module 14.

With reference now to the side view in FIG. 4, but also to FIGS. 1 and 2, the module deck 22 is at least double bottomed and arranged to be water-displacing so as to provide emergency reserve buoyancy to the offshore vessel 1. Preferably, the module deck 22 has a height h corresponding to between one sixth and one third of the height H of the longitudinal side beams 18. As is also seen in FIG. 4, the double bottomed module deck 22 has a bottom plane 36 of the module deck 22 which coincides with a bottom plane 38 of the longitudinal side beams 18.

In one embodiment of the invention, the longitudinal side beams 18 include wall sections 40 perforated with a plurality of side-beam openings 42. In the embodiments shown in FIGS. 1, 2 and 4, the side-beam openings 42 are shaped as substantially triangular cut-outs being oppositely arranged in pairs so as to form a truss-like pattern in said wall sections 40. However, in an alternative embodiment (not shown) each longitudinal side beam 18 is constituted by a conventional open truss-structure.

Figure 5:
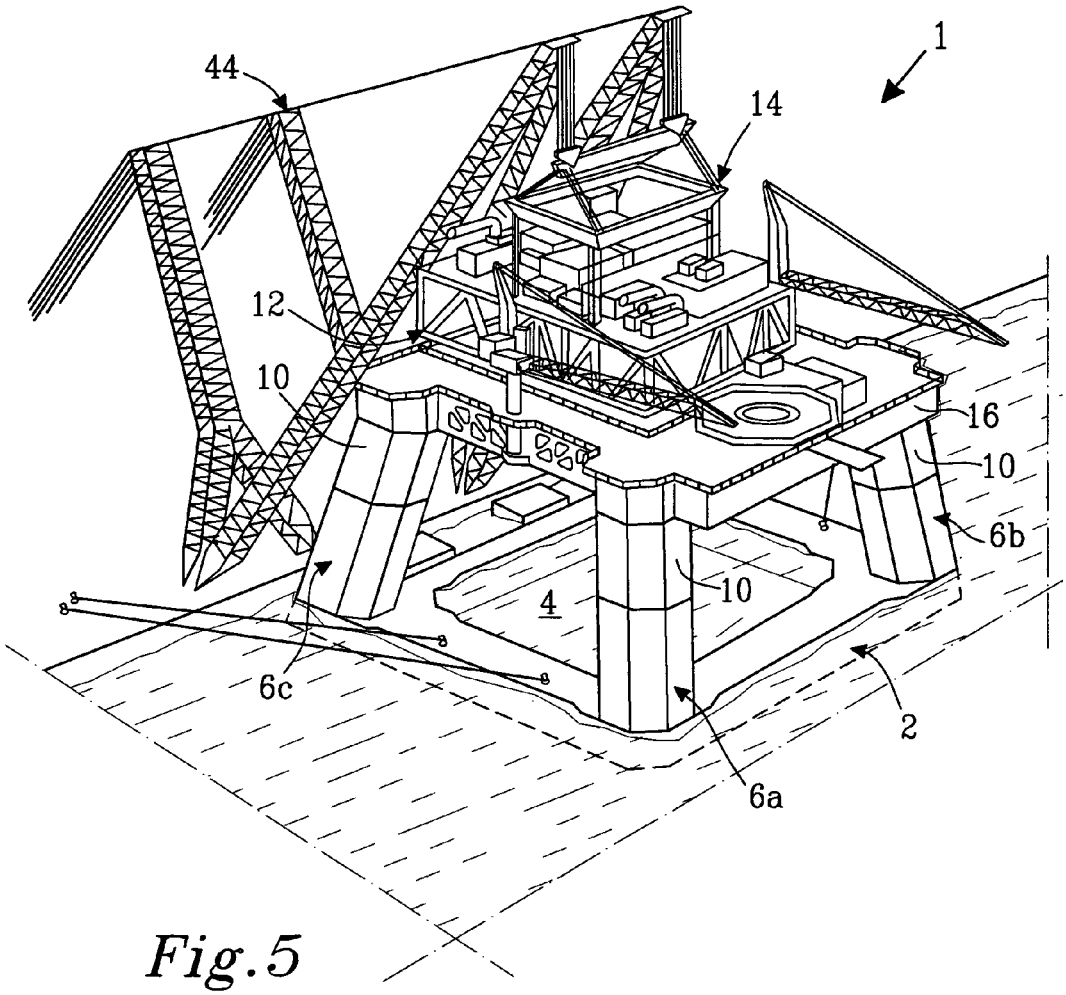
FIG. 5 shows a simplified perspective view of a semi-submersible offshore vessel according to the embodiment previously shown in FIGS. 3 and 4, wherein an operation module with hydrocarbon production equipment is being lifted into the recess of the vessel, and FIG. 6 finally shows a schematic, partial aft view of a semi-submersible vessel, wherein an operation module is provided with at suspension consoles arranged to abut corresponding load support surfaces on the two longitudinal side beams.

In FIG. 5, a method for positioning an operation module on the semi-submersible offshore vessel 1 is illustrated. A land based heavy-lift crane 44 is shown lifting an operation module 14 to a position above the module recess 12, whereafter the operation module 14 is lowered into the module recess 12.

Alternatively, the operation module 14 may be inserted or "skidded" from the aft into the module recess 12 via the open aft end 20 of said module recess 12. The operation module 14 may of course also be transferred from a floating heavy-lift crane barge (not shown) or other sea-going vessel to the module recess 12 of the offshore vessel 1.

It is to be understood that the invention is by no means limited to the embodiments described above, and may be varied freely within the scope of the appended claims. For example, the vessel 1 may have more than four columns 6*a*, 6*b*, 6*c*, 6*d*. Hence, for example, the vessel may have six columns, where an intermediate pair of columns (not shown) is inserted between the forward 6*a*, 6*b* and aft columns 6*c*, 6*d* seen in the appended drawings.

LIST OF REFERENCE NUMERALS

1. Semi-submersible offshore vessel
2. Ring-shaped lower pontoon
4. Central opening in lower pontoon
6*a*. Starboard forward column
6*b*. Port forward column
6*c*. Starboard aft column
6*d*. Port aft column
8. Upper deck structure
10. Upper portions of columns
12. Module recess
14. Operation module
16. Forward torsion box
18. Side beams
20. Open aft end of module recess
22. Module deck
24. Crew accommodation quarters
26. Compartments for utilities
28. Load support points on module deck
30. Suspension consoles on operation module
32. Load support surfaces on side beam
34. Vertical openings in module deck
36. Bottom plane of module deck
38. Bottom plane of side beams

40. Wall sections of side beams
42. Side-beam openings
44. Heavy-lift crane
L: Length of forward torsion box
D: Center-to-center distance between forward and aft columns
h: Height of double bottomed module deck
H: Height of side beams

What is claimed is:

1. A semi-submersible offshore vessel comprising:

a substantially ring-shaped lower pontoon;

starboard and port forward columns, extending upwards from said lower pontoon;

starboard and port aft columns, extending upwards from said lower pontoon, and an upper deck structure connecting upper portions of the columns with each other, said upper deck structure having a substantially rectangular module recess for receiving one or more operation modules, for example carrying hydrocarbon processing equipment, wherein said upper deck structure is generally C-shaped, having a forward torsion box extending transversally between the starboard and the port forward columns of the semi-submersible offshore vessel, and two mutually parallel longitudinal side beams extending aft from the starboard and port forward columns to the starboard and port aft columns, respectively, in such a way that said module recess exhibits an open aft end, the width of which substantially corresponds to the width of an operation module, and that said module recess is delimited in a downwardly direction by a substantially planar module deck which extends between and interconnects said longitudinal side beams.

2. The semi-submersible offshore vessel according to claim 1, wherein the forward torsion box is water-displacing and thus sealed from water-intrusion in such a way that it provides emergency reserve buoyancy to the offshore vessel.

3. The semi-submersible offshore vessel according to claim 1 or 2, wherein said module deck is at least double bottomed and arranged to be water-displacing so as to provide emergency reserve buoyancy to the offshore vessel.

4. The semi-submersible offshore vessel according to claim 1, wherein the longitudinal side beams are arranged to be water-displacing so as to provide emergency reserve buoyancy to the offshore vessel.

5. The semi-submersible offshore vessel according to claim 1, wherein the longitudinal side beams include wall sections perforated with a plurality of side-beam openings.

6. The semi-submersible offshore vessel according to claim 5, wherein said side-beam openings are shaped as substantially triangular cut-outs being oppositely arranged in pairs so as to form a truss-like pattern in said wall sections.

7. The semi-submersible offshore vessel according to claim 1, wherein each longitudinal side beam is constituted by a truss-structure.

8. The semi-submersible offshore vessel according to claim 1, wherein load support points for supporting structural load from the operational module or modules, are provided on the module deck, said load support points being located adjacent to the two longitudinal side beams.

9. The semi-submersible offshore vessel according to claim 1, wherein the operational module or modules, are provided with at least two suspension consoles arranged to abut corresponding load support surfaces on the two longitudinal side beams.

10. The semi-submersible offshore vessel according to claim 1, wherein said forward torsion box contains crew accommodation quarters.

11. The semi-submersible offshore vessel according to claim 1, wherein said module deck has a height corresponding to between one sixth and one third of the height of the longitudinal side beams.

12. The semi-submersible offshore vessel according to claim 1, wherein a bottom plane of the module deck coincides with a bottom plane of the longitudinal side beams.

13. The semi-submersible offshore vessel according to claim 1, wherein an operation module extends aft of said module deck.

14. The semi-submersible offshore vessel according to claim 1, wherein said module deck exhibits at least one vertical opening adapted for example for riser pipe handling or ventilation.

15. The semi-submersible offshore vessel according to claim 1, wherein said module deck is arranged to accommodate two or more operation modules, said operation modules being located next to each other and extending transversely across the module deck between the two longitudinal side beams.

16. The semi-submersible offshore vessel according to claim 1, wherein said forward torsion box extends forward of the forward columns of the vessel.

17. The semi-submersible offshore vessel according to claim 1, wherein the length of the forward torsion box, in a forward-aft direction corresponds to between one fifth to one half of the longitudinal center-to-center distance between the forward columns and the aft columns.

* * * * *